United States Patent [19]

Begliardi et al.

[11] Patent Number: 4,975,176

[45] Date of Patent: Dec. 4, 1990

[54] PROCESS FOR THE PRODUCTION OF BITUMENS OF A HIGH PENETRATION VALUE, APPARATUS FOR CARRYING IT OUT, AND PRODUCTS THUS OBTAINED

[76] Inventors: Fernando Begliardi, Via Brigate Partigiane 101, 19420 Follo (LaSpezia); Alessandro Cori, Via Monte Pertico, 112 - La Spezia, both of Italy

[21] Appl. No.: 93,746

[22] PCT Filed: Nov. 27, 1986

[86] PCT No.: PCT/EP86/00686

§ 371 Date: Jul. 1, 1987

§ 102(e) Date: Jul. 1, 1987

[87] PCT Pub. No.: WO87/03896

PCT Pub. Date: Jul. 2, 1987

[30] Foreign Application Priority Data

Dec. 20, 1985 [IT] Italy ..... 68096 A/85
Jul. 4, 1986 [IT] Italy ..... 67541 A/86

[51] Int. Cl.[5] ..... C08H 13/00

[52] U.S. Cl. ..... 208/3; 208/4; 208/5; 208/6; 208/34; 106/273.1; 106/284.1; 106/284.3; 106/284.4; 106/278; 106/279

[58] Field of Search ..... 208/3, 4, 5, 6; 106/273 R, 273 N, 278, 279, 273.1, 284.1, 284.3, 284.4; 422/215, 225, 226, 231

[56] References Cited

U.S. PATENT DOCUMENTS

| | | | |
|---|---|---|---|
| 2,450,756 | 4/1945 | Hoiberg | 106/284.1 |
| 2,762,758 | 9/1956 | Granmer | 208/6 |
| 3,373,101 | 3/1968 | Folkins | 106/279 |
| 3,531,375 | 9/1970 | Cheracei | 208/6 |
| 3,598,716 | 8/1971 | Fauber | 208/6 |
| 3,652,445 | 3/1972 | Senolt et al. | 208/6 |
| 3,661,765 | 5/1972 | Toyoguchi et al. | 208/6 |
| 3,663,281 | 5/1972 | Fauber | 106/279 |
| 3,703,393 | 11/1972 | Koons | 106/279 |
| 3,773,649 | 11/1973 | Senolt et al. | 208/6 |
| 3,839,190 | 11/1974 | Freese et al. | 208/6 |
| 3,856,657 | 12/1974 | Seifeld et al. | 208/6 |
| 3,923,633 | 12/1975 | Senolt et al. | 208/6 |
| 3,935,093 | 1/1976 | Senolt et al. | 208/6 |
| 4,001,091 | 1/1977 | Senolt et al. | 208/6 |
| 4,052,290 | 10/1977 | Cushman et al. | 208/6 |
| 4,338,137 | 7/1982 | Goodrich | 106/279 |
| 4,348,237 | 9/1982 | Ruckel | 106/273 R |

FOREIGN PATENT DOCUMENTS

| | | | |
|---|---|---|---|
| 435261 | 11/1974 | U.S.S.R. | 208/6 |
| 1104813 | 3/1967 | United Kingdom | 208/6 |
| 1179578 | 1/1970 | United Kingdom | 208/6 |
| 1366083 | 11/1974 | United Kingdom | 208/6 |
| 2081737 | 2/1982 | United Kingdom | 208/6 |

*Primary Examiner*—Helane Myers
*Attorney, Agent, or Firm*—Austin R. Miller

[57] ABSTRACT

The process permits to produce bitumens having a high penetration value by oxidation of base bitumens with small volumes of gaseous oxidizers, preferably air, at a temperature between 170° and 250°, preferably 200° C., by turbodispersion of the gaseous phase in the bituminous mass by means of a rapid turbodisperser.

By adding appropriate fluxes and operating in the presence of catalysts, the technological characteristics of the end product can be varied until obtaining blends of bitumens that are adapted for new applications.

The turbodisperser is provided with an impeller constituted by a plane disk carrying on its periphery a series of teeth made preferably with the active side located on the diameter of the impeller and the angle at the vertex greater than 45°.

13 Claims, 3 Drawing Sheets

PROCESS FOR THE PRODUCTION OF BITUMENS OF A HIGH PENETRATION VALUE, APPARATUS FOR CARRYING IT OUT, AND PRODUCTS THUS OBTAINED

The present invention relates to a process for the production of bitumens of a high penetration value, to apparatus adapted for carrying out this process, and to the new products thus obtained.

More particularly, the invention relates to a process for producing bitumens having a high softening point as expressed by the Ring and Ball value, associated with excellent penetration values, so that the obtained bitumens are of a high technological value in the preparation of bituminized felts, bituminous sheaths, bitumen based tiles, bituminized special papers, coatings for pipelines, dams and tubes, electrical insulating materials, waterproofing compounds generally, rubber mixtures, and the like.

The starting material for the production of the bitumens is the heavy residue of petroleum distillation. By varying the degree of vacuum during the distillation, regulating the temperature and introducing water vapour in a determined quantity, the hardness of the obtained product can be increased, but the latter is still very sensitive to variations in temperature.

Various methods are known which are adapted to produce bitumens with characteristics of sensitivity to temperature better than those of distillation bitumens. The technique that is most used is that of air blowing which, however, provides products of poor ductility and penetration values unless one resorts to methods of fluxing and subsequent blowing which considerably complicate the process and increase the cost of the end product. Some methods are based on treatment with dehydrogenating chemical compounds combined with oxidation by blowing in large volumes of air (starting from 80–100 $Nm^3/h$ per ton of base bitumen) at high temperature (280°–300° C.); others use mechanical systems to improve the contact times between air and bitumen so as to be able to obtain higher values of the penetration index.

In U.S. Pat. Nos. 3,923,633 and 3,935,093 there are described processes of oxidizing bitumen by blowing air into a reactor provided with mechanical stirring systems adapted to improve contact between the air and bitumen. Although the temperature of these processes (230°–250° C.) is lower than that of many other known blowing processes, it is to be noted that still use is made of very large volumes of air (up to 570 $Nm^3/h$) and that a complex regulation of the speed of rotation of the stirrer is required.

It is the object of the present invention to eliminate or reduce the disadvantages of the known methods for the production of bitumen and to provide a process for producing bitumens having exceptionally good values of the softening point and penetration and which requires operating temperatures that are decidedly lower than those of the known processes, and minimum quantities of gaseous oxidizers, all this being obtained by relatively simple apparatus and without the need of sophisticated regulations or checks of the apparatus and process.

The above-mentioned and other objects and advantages of the invention, which will become apparent from the following description, are achieved, according to a first subject matter of the invention, by a process for the production of bitumen of high quality by blowing a bituminous mass comprising a base bitumen obtained as a residue of vacuum distillation of petroleum, characterized in that a turbodispersion of a gaseous oxidizing means is carried out in said bituminous mass at a temperature between 170° and 250° C., in which the gaseous oxidizer is dispersed in the bituminous mass in a proportion of between 0.1 and 1 $m^3/h/ton$.

The gaseous oxidizer is oxygen which may be used in the pure state or, more conveniently, as atmospheric oxygen. In this case air is used in a fivefold proportion of that defined above for the pure oxidizer, namely in a proportion of between 0.5 and 5 $m^3/h$ per ton of base bitumen.

The term "turbodispersion" is intended to denote a vigorous dispersion of the gaseous oxidizer in the liquid base bitumen at a rate of turbulence obtained by mechanical stirring of the reaction mass by means of a turbodisperser. According to an essential characteristic of the invention turbodispersion makes superfluous both blowing of air under pressure and the use of large volumes of air which are typical for the known processes.

The process according to the invention can be carried out in the presence of catalysts such as salts of iron, calcium, aluminium, phosphorus compounds, and some nitrogenous compounds such as the amines, which increase the reaction rate although this is not strictly necessary as the reaction rate can be considered sufficiently high even in the absence of catalysts. It has been found that the catalysts permit the operator to modify the length of the molecular chains to favour the obtainment of end products of high technological characteristics. Further, they exert a favourable influence on the flash point of the end product by raising it by several points.

The base bitumens, which constitute the starting material of the process according to the invention, are constituted by bitumens derived from vacuum distillation of petroleum and having penetration values within the limits of 180/200, 80/100, 60/70 and 40/50. The choice of the base bitumen can influence the characteristics of the end product. Therefore, appropriate fluxes may be added to the base bitumen, i.e. fluxes of petroleum blends such as fuel oils, lubricant bases, recovery oils and the like, which are adapted to introduce molecular chains capable of imparting to the end product, after reaction, the desired technological characteristics.

A second subject matter of the invention is constituted by the new types of oxidized bitumens which can be obtained by the above-mentioned process and which are characterized by pairs of the values of the softening point, as expressed by the Ring and Ball value, and of penetration, which cannot be found in the hitherto known bitumens.

A further subject matter of the invention consists in providing a reaction apparatus comprising a reactor in which there is mounted at least one impeller constituted by a plane disk carrying on its periphery an array of teeth. It has been found that with such an impeller a rapid rate of turbodispersion is obtained which substantially improves the efficiency of the process.

The invention will also be described with reference to the accompanying Figures which, merely by way of a non-limiting example, illustrate the apparatus adapted to carry out the process according to the invention, and in which.

Figure 1:
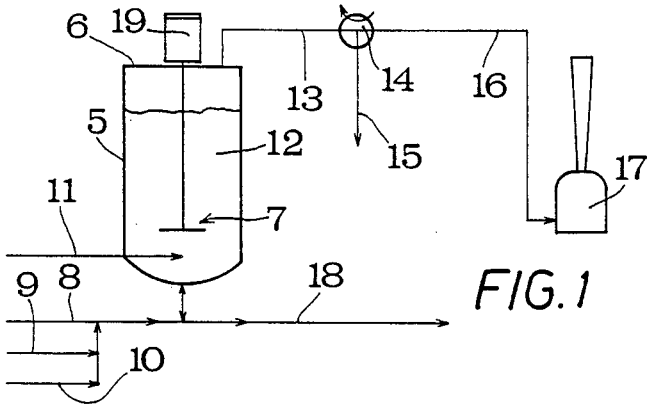
FIGS. 1, 2 and 3 illustrate the apparatus adapted to carry out three different variations of the process according to the invention.

Indicated by 5 in FIG. 1 is a reactor provided with a cover 6 and a mechanical stirrer 7 driven by a motor 19. The reactor is also equipped with heating means, not shown. The base bitumen 8 is introduced into the reactor together, if desired, with fluxes 9 and, if desired, a catalyst 10.

According tho the starting base bitumen and the percentage of addition of fluxes, a very wide range of oxidized bitumens can be obtained. As a general principle, it may be suitable to work with base bitumens having a high penetration (180/200, 80/100) in view of the presence of a greater quantity of reactive chains, instead of working with bitumens of the 40/50 or 60/70 types. Further, by adding variable percentages of catalysts, the reaction time may be varied as desired, to obtain end products with the desired characteristics.

The bituminous mass is heated to the temperature of about 200° C. and small amounts of air are bubbled thereinto through line 11 from below. By stirring the bituminous mass a turbodispersion of the air is obtained which increases the efficiency of the oxidation and makes superfluous the blowing in under pressure of large volumes of air, as was the current practice in the known methods. Therefore, the air is fed in by simple low pressure differential fans, not shown. The vapours forming in the reactor during the reaction are fed through the conduit 13 to a water condenser 14 from which the condensed hydrocarbon fractions 15 are discharged. The incondensable tail gases 16 can be fed to a burner 17 for combustion. The reactor 5 is designed for discontinuous operation, so that, once the bituminous mass has reacted for the time required, it is discharged and fed to stocking through the conduit 18, after which a new phase of filling the reactor is started.

It is interesting to note that the execution of the process at a constant thermal level of about 200° C. ensures high yields of the end product with low losses and absolute absence of carbon formation both in the product and the apparatus. This represents an essential advantage over the known methods of oxidation by blowing of air, which usually start at temperatures of 220° C., but being exothermic, rapidly reach temperatures of 280°-300° C., which are maintained by removal of heat from the reaction mass. However, at such thermal levels there are risks of bursts and explosions by spontaneous ignition of the mass and it is not possible to avoid molecular cracking phenomena with carbon formation and consistent losses in the yields of the oxidation process.

The provision of a turbodispersion of the air in the bituminous mass requires the application of rather high specific powers to the stirrer which is of the impeller turbodisperser type. On the contrary, in comparison with the conventional discontinuous blowing systems, working times are obtained which are reduced by one half or a third.

Figure 2:
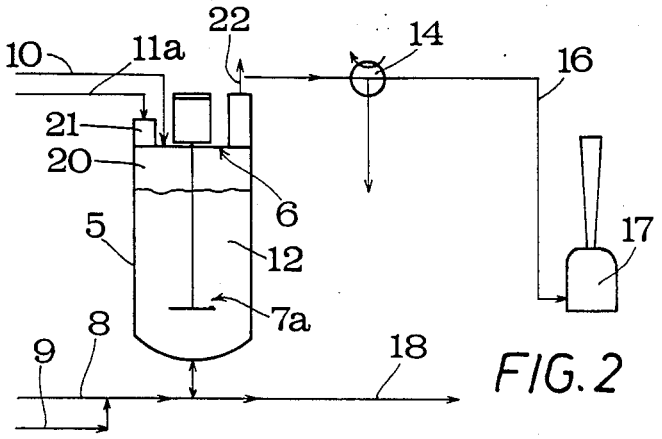

In FIG. 2 there is shown a second scheme of the process according to the invention which substantially differs from that of FIG. 1 by the different form of feeding of the air. In fact, in this case the air 11*a* is fed, again in small amounts, into the top of the reactor 5, i.e. into the room 20 defined between the surface of the bituminous mass 12 and the cover 6 of the reactor.

This scheme of process gives prominence to an important characteristic of the invention, according to which it is possible to obtain excellent results with regard to the yield of oxidation and quality of the end product even by simple contact of the gaseous phase with the surface of the bituminous mass without any need of direct immersion into the reaction mass. The use of low pressure differential fans 21, therefore, only serves to renew the volume of air in the room 20 in contact with the surface of the bitumen. The efficiency of oxidation is therefore mainly to be attributed to the turbodispersion of the gaseous surface phase in the reaction mass by means of a rapid turbodisperser 7*a*.

The base bitumen 8, if desired, flux 9 and, if desired, catalyst 10 are introduced into the reactor as explained previously. Also the remaining portions of the apparatus remain unchanged, except for the possibility of direct discharge 22 of the reaction vapours into the atmosphere, if this does not cause problems of pollution according to the legislation in force.

Figure 3:
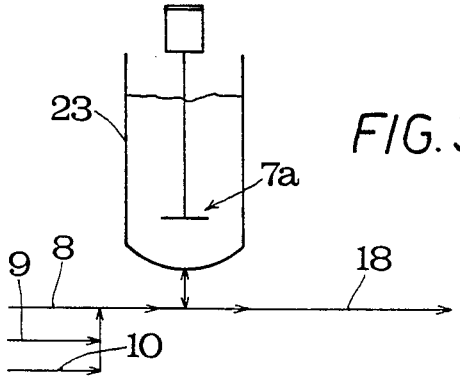

With regard to this latter possibility there is illustrated in FIG. 3 a third scheme of a process for carrying out the present invention in a manner very much simplified over what has been described previously. According to this scheme, the process is carried out in an open reactor 23 again equipped with a rapid turbodisperser 7*a* and provided with means for loading the base bitumen 8, flux 9 and catalyst 10, as well as means 18 for discharging the blown bitumen. With such apparatus the blowing air simply enters into contact from the atmosphere with the surface of the bitumen and is dispersed therein by the effect of turbodispersion with continuous renewal of the gaseous surface phase directly from the atmosphere. In this case the reaction gases are directly released to atmosphere if this is permitted by the location of the plant and the legislation in force on pollution control.

Figure 4:
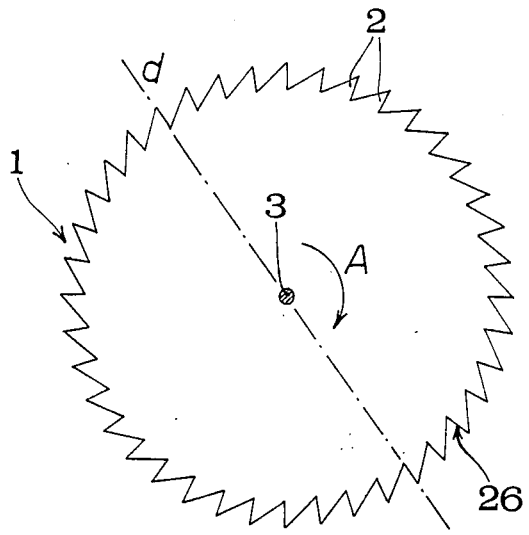
FIG. 4 is a top plan view of an impeller forming part of the apparatus of the preceding Figures.
Figure 5:
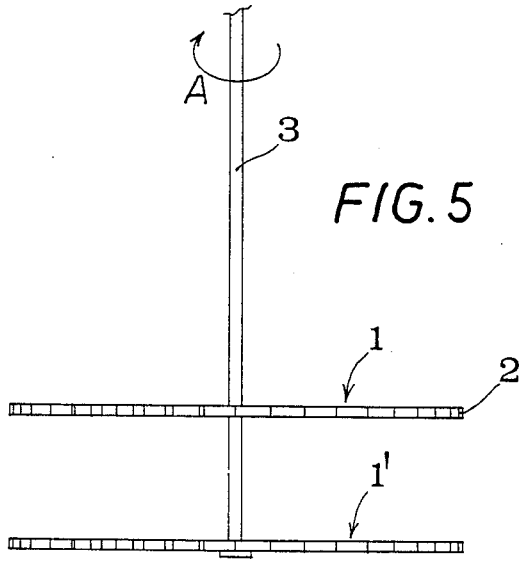
FIG. 5 is an elevational view of the impeller of FIG. 4.
Figure 6:
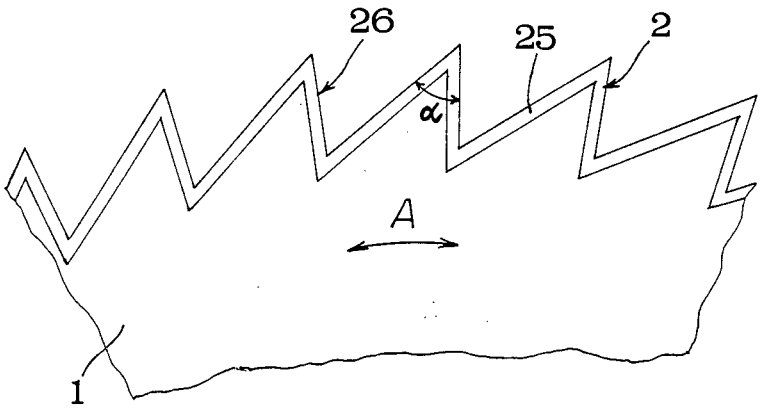
FIG. 6 is a part plan view of the impeller of FIG. 4.
Figure 7:
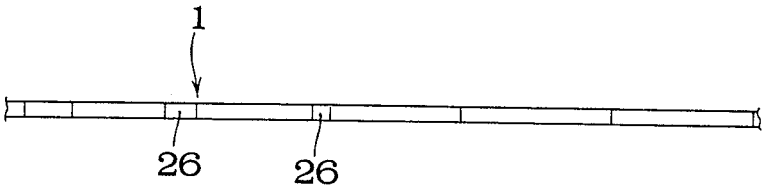
FIG. 7 is a side view of the detail of FIG. 6.

With reference to FIGS. 4 to 7 there is shown an embodiment of the turbodisperser 7 or 7*a* of the preceding Figures, which constitutes a further subject matter of the invention. This embodiment consists in an impeller adapted to carry out a turbodispersion of high efficiency in a reactor for reactions in the heterogenous phase. This impeller comprises a plane disk 1 provided along its circumference with an array of teeth 2. The disk 1 is firmly mounted on a shaft 3 so as to constitute a stirrer which is normally mounted in an axial disposition within the reactor. The stirrer may also be of the multiple impeller type, as illustrated in FIG. 5, wherein two impellers 1 and 1' are firmly mounted on the same shaft. There are also possible embodiments with three or more impellers of the same type as indicated above. Preferably the teeth 2 are coated with a metal alloy 25 of high strength and hardness such as stellite, as illustrated in FIG. 6. FIG. 7 is a profile view of the detail of FIG. 6. To achieve the high efficiency of the process as discussed previously, the ratio between the diameter of the reactor and the diameter of the impeller is between 2.5 and 4 whereas the optimum ratio between the diameter of the impeller and the distance thereof from the bottom of the reactor is between 2 and 1. The ratio between the height of the liquid head above the impeller and the diameter of the impeller is preferably between 0.6 and 0.2. The number of the teeth 2 of the impeller is preferably between 20 and 80.

It has been found advantageous to make the impeller so that the active side 6 of each tooth will be located on the diameter d of the impeller (FIG. 4). Further, the angle at the vertex $\alpha$ of the teeth is preferably greater than 45° (FIG. 6).

With these characteristics of construction and by actuating the impeller in the direction of the arrow A of FIG. 4, 5 and 6, the active side 26 of each tooth is subjected to contact by the reaction mass and it is mainly through this active side that the power of the impeller is dissipated. It has been found that this will increase the efficiency of the turbodispersion.

After having described the apparatus for carrying out the process for the production of bitumen according to the invention, now some specific working examples will be described which better permit to appreciate the advantages of the invention.

EXAMPLES 1 TO 8

The apparatus used is of the type schematically illustrated in FIG. 1 and is on a pilot plant scale, in which the reactor has a capacity of 40 l, is provided with heating coils, is suitably insulated, and is equipped with a turbine stirrer which dissipates a power of 2 HP, makes 1440 revolutions per minute, with a peripheral speed of the impeller of 680 meters per minute.

Into this reactor there are introduced 20 kg of Tja Juana type Venezuelan base bitumen 180/200 fluxed with fuel oil of viscosity E at 50° C. of 15–20 with a sulphur content of 4% indicated as ATZ (high sulphur content). As catalysts aluminium salts expressed as $Al_2O_3$ and ferric chloride have been used. The temperature has been raised up to and maintained at 200° C.±5.

From the bottom of the vessel there have been fed in 50 l of air corresponding to a flow rate of 2.5 $m^3$/h/ton of the product. The small amount of vapours and gases leaving the reactor through the conduit 13 of FIG. 1 are fed to a water condenser having a suitable exchange surface. The condensates formed of water and oil are fed to a separator in which water and oil separate by gravity. The oil is fed to combustion. The incondensable gases are fed to a chimney or to final combustion in a burner. After a reaction time of 30, 60 or 90 minutes, the end product is discharged.

In table 1 provided hereafter there are indicated the data relating to the percentage of flux and catalyst to each example of the base bitumen indicated above and there are also indicated the characteristics of the blown bitumen obtained, as expressed in pairs of the Ring and Ball and Penetration values as a function of the reaction time (t).

TABLE 1

| No. of Example | Operating Conditions | t = 30′ | t = 60′ | t = 90′ |
|---|---|---|---|---|
| 1 | ATZ = 0%<br>$Al_2O_3$ = 0.5%<br>$FeCl_3$ = 0.5% | 61/60 | 80/37 | 105/24 |
| 2 | ATZ = 8%<br>$Al_2O_3$ = 0.5%<br>$FeCl_3$ = 0.5% | 70/50 | 91/25 | 119/15 |
| 3 | ATZ = 16%<br>$Al_2O_3$ = 0.5%<br>$FeCl_3$ = 0.5% | 67/55 | 87/40 | 110/30 |
| 4 | ATZ = 24%<br>$Al_2O_3$ = 0.5%<br>$FeCl_3$ = 0.5% | 60/100 | 70/62 | 94/41 |
| 5 | ATZ = 0%<br>$Al_2O_3$ = 1%<br>$FeCl_3$ = 1% | 78/37 | 110/22 | 136/12 |
| 6 | ATZ = 8%<br>$Al_2O_3$ = 1%<br>$FeCl_3$ = 1% | — | 75/46 | 105/23 |
| 7 | ATZ = 16%<br>$Al_2O_3$ = 1%<br>$FeCl_3$ = 1% | — | 80/65 | 118/37 |
| 8 | ATZ = 24%<br>$Al_2O_3$ = 1%<br>$FeCl_3$ = 1% | — | 96/45 | 125/27 |

EXAMPLES 9 TO 16

The apparatus used is of the type schematically illustrated in FIG. 3, in which the reactor again has a capacity of 40 l, is provided with heating coils, is suitably insulated and is equipped with a turbine stirrer of the power of 2 HP, 1440 revolutions per minute, and peripheral speed of the impeller of 2714 meters per minute.

Into this reactor there have been introduced 20 kg of type Tja Juana Venezuelan base bitumen 180/200 fluxed with fuel oil of viscosity E at 50° C. of 15–20, as in the preceding case. The catalysts, too, are those used in the Examples 1 to 8. The temperature is again that of 200° C.±5.

By way of difference over Examples 1 to 8, the air is received by the surface of the bituminous mass directly from the atmosphere.

The remaining conditions and operations are those already described with reference to Examples 1 to 8.

In Table 2 provided hereafter there are indicated the data relating to the percentage of flux and catalyst added in each Example of the base bitumen indicated above and there are also indicated the characteristics of the blown bitumen obtained, as expressed in pairs of the Ring and Ball and Penetration values as a function of the reaction time (t).

TABLE 2

| No. of Example | Operating Conditions | t = 30′ | t = 60′ | t = 90′ |
|---|---|---|---|---|
| 9 | ATZ = 0%<br>$Al_2O_3$ = 0.5%<br>$FeCl_3$ = 0.5% | 72/40 | 95/20 | 118/13 |
| 10 | ATZ<br>$Al_2O_3$ = 0.5%<br>$FeCl_3$ = 0.5% | 71/45 | 93/25 | 125/15 |
| 11 | ATZ<br>$Al_2O_3$ = 0.5%<br>$FeCl_3$ = 0.5% | 76/42 | 108/25 | 145/15* |
| 12 | ATZ = 24%<br>$Al_2O_3$ = 0.5%<br>$FeCl_3$ = 0.5% | 80/40 | 115/25 | 141/20* |
| 13 | ATZ = 0%<br>$Al_2O_3$ = 1%<br>$FeCl_3$ = 1% | 90/30 | 126/15 | 148/10* |
| 14 | ATZ = 8%<br>$Al_2O_3$ = 1%<br>$FeCl_3$ = 1% | 85/35 | 125/20 | 156/1* |
| 15 | ATZ = 16%<br>$Al_2O_3$ = 1%<br>$FeCl_3$ = 1% | 98/30 | 137/20 | 165/13* |
| 16 | ATZ = 24%<br>$Al_2O_3$ = 1%<br>$FeCl_3$ = 1% | 86/43 | 115/32 | 146/20* |

By way of example, by an asterisk * are indicated some types of blown bitumens that can be obtained by the process according to the invention and which are not commercially available. These bitumens, which by the particular Ring and Ball and Penetration values are located outside the existing specifications, are particularly advantageous for waterproofing and tube coatings and thus open new fields of application for the use of blown bitumens.

EXAMPLES 17 TO 20

In the same manner and by the same apparatus as described with reference to Examples 9 to 16, four further air blowing tests have been carried out with the same starting materials, but without the use of catalysts. The results are shown in Table 3 wherein the data are expressed in the same manner as explained previously.

TABLE 3

| No. of Example | Operating Conditions | t = 30′ | t = 60′ | t = 90′ |
|---|---|---|---|---|
| 17 | ATZ = 0%<br>$Al_2O_3$ = 0%<br>$FeCl_3$ = 0% | 45/80 | 50/60 | 56/50 |
| 18 | ATZ = 8%<br>$Al_2O_3$ = 0%<br>$FeCl_3$ = 0% | 56/60 | 75/35 | 88/25 |
| 19 | ATZ = 16%<br>$Al_2O_3$ = 0%<br>$FeCl_3$ = 0% | 45/110 | 58/52 | 70/32 |
| 20 | ATZ = 24%<br>$Al_2O_3$ = 0%<br>$FeCl_3$ = 0% | 46/160 | 56/63 | 65/46 |

EXAMPLES 21 TO 24

In the same manner and by the same apparatus as described with reference to Examples 1 to 8, four further air blowing tests have been carried out with the same starting material, without using catalysts. The results are shown in Table 4 wherein the data are expressed in the same manner as explained previously.

| No. of Example | Operating Conditions | t = 30′ | t = 60′ | t = 90′ |
|---|---|---|---|---|
| 21 | ATZ = 0%<br>$Al_2O_3$ = 0%<br>$FeCl_3$ = 0% | 51/53 | 59/35 | 70/20 |
| 22 | ATZ = 8%<br>$Al_2O_3$ = 0%<br>$FeCl_3$ = 0% | 49/116 | 55/42 | 65/32 |
| 23 | ATZ = 16%<br>$Al_2O_3$ = 0%<br>$FeCl_3$ = 0% | 42/145 | 47/91 | 54/52 |
| 24 | ATZ = 24%<br>$Al_2O_3$ = 0%<br>$FeCl_3$ = 0% | 42/185 | 48/110 | 55/71 |

EXAMPLES 25 TO 28

The typical plant used is of the type illustrated in FIG. 2. It comprises a reactor 5 which is sealingly closed and has a capacity of 10 $m^3$ and in which there is mounted a stirrer *7a* provided with an impeller 1 according to the invention (FIGS. 4 to 7), this impeller having a diameter of 750 mm and being driven at 1440 revolutions per minute by an electric motor of 135 Kw. Connected to the reactor is a pipe 11*a* for feeding in air which is supplied to the free surface of the liquid which is stirred by a centrifugal fan of low pressure and a capacity of 100 $m^3$/h. The base bitumen is introduced by the pipe 8 and the fluxes, if any, by the pipe 9, while the pipe 10 supplies the catalysts, if any. The blown bitumen is discharged by the line 18 whereas the excess air and water vapour produced by the reaction are fed through the pipe 13 to a condenser - separator assembly 14 where the water is separated from the incondensable gases which through a line 16 are fed either directly to a discharge in a chimney or preferably to a boiler 17 for final combustion of the small quantities of hydrocarbons which may produce phenomena of pollution of the atmosphere.

The reactor and pipes are heated by appropriate means and the plant may operate continuously by the introduction of reagents and catalysts and the simultaneous withdrawal of the finished products by volumetric pumps controlled by meters.

The process of blowing and modification of the base bitumens is performed in a temperature range between 170° and 250° C. with an amount of compressed air of between 0.5 and 5 $Nm^3$/h/ton of base bitumen in the presence of catalysts such as Fe, Ca, Al, P and amino bases either individually or in mixtures. The obtainment of blown bitumens having a very high penetration value requires the use of appropriate fluxes constituted, for example, by heavy products of either animal or vegetable petroleum origin or by recovery lubricant oils added up to a maximum of 40% by weight based on the base volume.

In the reactor of the type described above there have been treated residues of distillation or refinery cracking processes, having a density of more than 0.900 g/$cm^3$ with a viscosity E°50 of 15–20 and a sulphur content of about 4% by weight.

The results are shown in the Table 5 in which near the values of the reaction time there are indicated the technological characteristics of the products obtained as expressed in the manner explained previously.

TABLE 5

| No. of Example | Catalyst | t = 30′ | t = 45′ | t = 60′ |
|---|---|---|---|---|
| 1 | Polyamine = 0%<br>$Al_2O_3$ = 1%<br>$FeCl_3$ = 1% | 80/260 | 120/80 | 140/50 |
| 2 | Polyamine = 0.5%<br>$Al_2O_3$ = 1%<br>$FeCl_3$ = 1% | 50/250 | 80/95 | 110/75 |
| 3 | Polyamine = 1.5%<br>$Al_2O_3$ = 1%<br>$FeCl_3$ = 1% | 50/170 | 80/80 | 120/40 |
| 4 | Polyamine = 4%<br>$Al_2O_3$ = 1%<br>$FeCl_3$ = 1% | 42/250 | 66/122 | 96/60 |

The products obtained are new and fall within the field of road bitumens, however, with the possibility of a wider and more general use in the field of bituminous derivates.

Some embodiments of the invention have been described but the invention is liable to numerous modifications and variations within the scope of the same inventive idea. In particular, by varying the range of base bitumens and selecting the catalysts, the characteristics of the desired end product can be varied.

We claim:

1. Process for the production of bitumens of improved penetration value by oxidation of a bituminous mass comprising a base bitumen obtained as a residue of vacuum distillation of petroleum, wherein turbodispersion of a gaseous oxidizing agent is carried out in said bituminous mass at a temperature between 170° and 250° C., in which the gaseous oxidizing agent is dispersed in the bituminous mass in a proportion of between 0.1 and 1 $Nm^3/h/ton$ of said base bitumen by contact with a turbodisperser rotating at a speed of at least about 1400 r.p.m.

2. Process for the production of bitumens according to claim 1, wherein said gaseous oxidizing agent is constituted by oxygen.

3. Process for the production of bitumens according to claim 1, wherein said bituminous mass also contains a flux selected from the group consisting of fuel oils, lubricant bases and recovery oils for the base bitumen.

4. Process according to claim 3, wherein said flux is present in the bituminous mass in an amount of up to 40% by weight of the base bitumen.

5. Process for the production of bitumens according to claim 1, wherein the oxidation of the bituminous mass is carried out in the presence of a catalyst selected from the group consisting of salts of iron, calcium, aluminum, phosphorus compounds and amines, either individually or as mixtures thereof.

6. Process according to claim 5, wherein said oxidation catalyst is added to the bituminous mass in a proportion of up to 5% of the base bitumen.

7. Process for the production of bitumens according to claim 1, wherein the bituminous mass is contained in a reactor into which the air is bubbled from below and is dispersed therein by said turbodisperser.

8. Process for the production of bitumens according to claim 1, wherein the bituminous mass is contained in a reactor into which the air is fed from above to the surface of the mass in which it is dispersed only by the effect of the stirring produced by said turbodisperser.

9. Process for the production of bitumens according to claim 1, wherein the bituminous mass is contained in an open reactor which permits the surface of the bituminous mass to directly pick up the atmospheric air required for oxidation, the air being dispersed in the bituminous mass only by the effect of the stirring produced by said turbodisperser.

10. Process for the production of bitumens according to claim 1, wherein it is carried out with the addition of a flux selected from the group consisting of fuel oils, lubricant bases and recovery oils in a proportion of between 0 and 40% and an oxidation catalyst in a proportion of between 0 and 5% by weight based on the weight of the base bitumen.

11. Process for the production of bitumens of improved penetration value, comprising oxidizing a petroleum distillation or refinery cracking residue having a density of more than 0.900 $g/cm^3$ and a viscosity, E°50 of between 15 and 20 by turbodispersion of air in a proportion between 0.5 and 5 $Nm^3/h$ per ton of the residue at a temperature of between 170° and 250° C. in the presence of a catalyst selected from the group consisting of salts of iron, calcium, aluminum, phosphorus compounds and amines, either individually or as mixtures thereof, in a proportion of between 0 and 6% by weight based on said residue.

12. The process as defined in claim 1, wherein turbodispersion is carried out for about 90 minutes or less.

13. Process for the production of bitumens of improved penetration value by oxidation of a bituminous mass comprising a base bitumen obtained as a residue of vacuum distillation of petroleum, wherein turbodispersion of air is carried out in said bituminous mass at a temperature of between 170° and 250° C., in which the air is dispersed in the bituminous mass in a proportion of between 0.5 and 5 $Nm^3/h/ton$ by contact with a turbodisperser rotating at a speed of at least about 1400 r.p.m., said contact being controlled to produce a blown bitumen having a softening point, expressed by its ring and ball value, of between 40 and 80 and by a penetration of 25° C. of between 170 and 270.

* * * * *